US009704633B2

(12) United States Patent
Ozdemir et al.

(10) Patent No.: US 9,704,633 B2
(45) Date of Patent: Jul. 11, 2017

(54) MOTOR VEHICLE SOLENOID FOR A STARTER MOTOR

(71) Applicant: REMY TECHNOLOGIES, L.L.C., Pendleton, IN (US)

(72) Inventors: Muhammed Emin Ozdemir, Noblesville, IN (US); Steve Burton, Anderson, IN (US); David Durant, Anderson, IN (US)

(73) Assignee: REMY TECHNOLOGIES, L.L.C., Pendleton, IN (US)

( * ) Notice: Subject to any disclaimer, the term of this patent is extended or adjusted under 35 U.S.C. 154(b) by 208 days.

(21) Appl. No.: 14/742,888

(22) Filed: Jun. 18, 2015

(65) Prior Publication Data

US 2015/0369194 A1 Dec. 24, 2015

Related U.S. Application Data

(60) Provisional application No. 62/013,778, filed on Jun. 18, 2014.

(51) Int. Cl.

| | |
|---|---|
| ***F02N 11/04*** | (2006.01) |
| ***H01F 7/08*** | (2006.01) |
| ***H01F 7/16*** | (2006.01) |
| *F02N 11/00* | (2006.01) |
| *H01F 7/06* | (2006.01) |

(52) U.S. Cl.

CPC ..... *H01F 7/08* (2013.01); *H01F 7/1607* (2013.01); *F02N 11/00* (2013.01); *H01F 2007/062* (2013.01)

(58) Field of Classification Search

CPC ..... F02N 11/00; F02N 15/00; F02N 15/006; F02N 11/04; H01F 7/08; H01F 7/1607; H01F 2007/062; H02K 5/04; H02K 7/20; H02K 11/0094

See application file for complete search history.

(56) References Cited

FOREIGN PATENT DOCUMENTS

| | | | |
|---|---|---|---|
| CN | 201191585 Y | * | 2/2009 |
| CN | 204088206 U | * | 1/2015 |

* cited by examiner

*Primary Examiner* — Hung Q Nguyen
*Assistant Examiner* — Xiao Mo
(74) *Attorney, Agent, or Firm* — Cantor Colburn LLP

(57) ABSTRACT

A motor vehicle solenoid including a solenoid housing, at least one coil arranged in the housing, and at least one diode holder arranged in the housing adjacent the at least one coil. The at least one diode holder includes a body having an outer circumferential edge and at least one diode pocket. The at least one diode pocket houses a diode electrically connected to the at least one coil.

13 Claims, 5 Drawing Sheets

MOTOR VEHICLE SOLENOID FOR A STARTER MOTOR

CROSS-REFERENCE TO RELATED APPLICATION

This application is a non-provisional of U.S. Provisional Patent Application No. 62/013,778 filed on Jun. 18, 2014, the disclosure of which is incorporated herein by reference in its entirety.

BACKGROUND OF THE DISCLOSURE

Exemplary embodiments pertain to the art of motor vehicles and, more particularly, to a motor vehicle solenoid for a starter motor.

Internal combustion engines generally include a starter motor. The starter motor is electrically energized to initiate operation of the internal combustion engine. A typical starter includes a starter motor that generates torque that is passed to a pinion gear and a solenoid. The solenoid shifts the pinion gear into engagement with a ring gear on the internal combustion engine. Once engaged, the starter motor rotates the pinion to spin the ring gear and initiate operation of the internal combustion engine. The solenoid may include various electronic components that cooperate to shift the pinion gear into engagement with the ring gear.

BRIEF DESCRIPTION OF THE DISCLOSURE

Disclosed is a motor vehicle solenoid including a solenoid housing, at least one coil arranged in the housing, and at least one diode holder arranged in the housing adjacent the at least one coil. The at least one diode holder includes a body having an outer circumferential edge and at least one diode pocket. The at least one diode pocket houses a diode electrically connected to the at least one coil.

Also disclosed is an internal combustion engine including an engine block, a ring gear mounted relative to the engine block, and a starter motor mounted to the engine block at the ring gear. The starter motor includes a motor housing, a pinion housing and a solenoid mounted relative to one of the motor housing and the pinion housing. The solenoid includes a solenoid housing, at least one coil arranged in the housing, and at least one diode holder arranged in the housing adjacent the at least one coil. The at least one diode holder includes a body having an outer circumferential edge and at least one diode pocket. The at least one diode pocket houses a diode electrically connected to the at least one coil.

Further disclosed is a motor vehicle starter motor including a motor housing, a pinion housing, and a solenoid mounted relative to one of the motor housing and the pinion housing. The solenoid includes a solenoid housing, at least one coil arranged in the housing, and at least one diode holder arranged in the housing adjacent the at least one coil. The at least one diode holder includes a body having an outer circumferential edge and at least one diode pocket. The at least one diode pocket houses a diode electrically connected to the at least one coil.

BRIEF DESCRIPTION OF THE DRAWINGS

The following descriptions should not be considered limiting in any way. With reference to the accompanying drawings, like elements are numbered alike.

DETAILED DESCRIPTION OF THE DISCLOSURE

A detailed description of one or more embodiments of the disclosed apparatus and method are presented herein by way of exemplification and not limitation with reference to the Figures.

Figure 1:
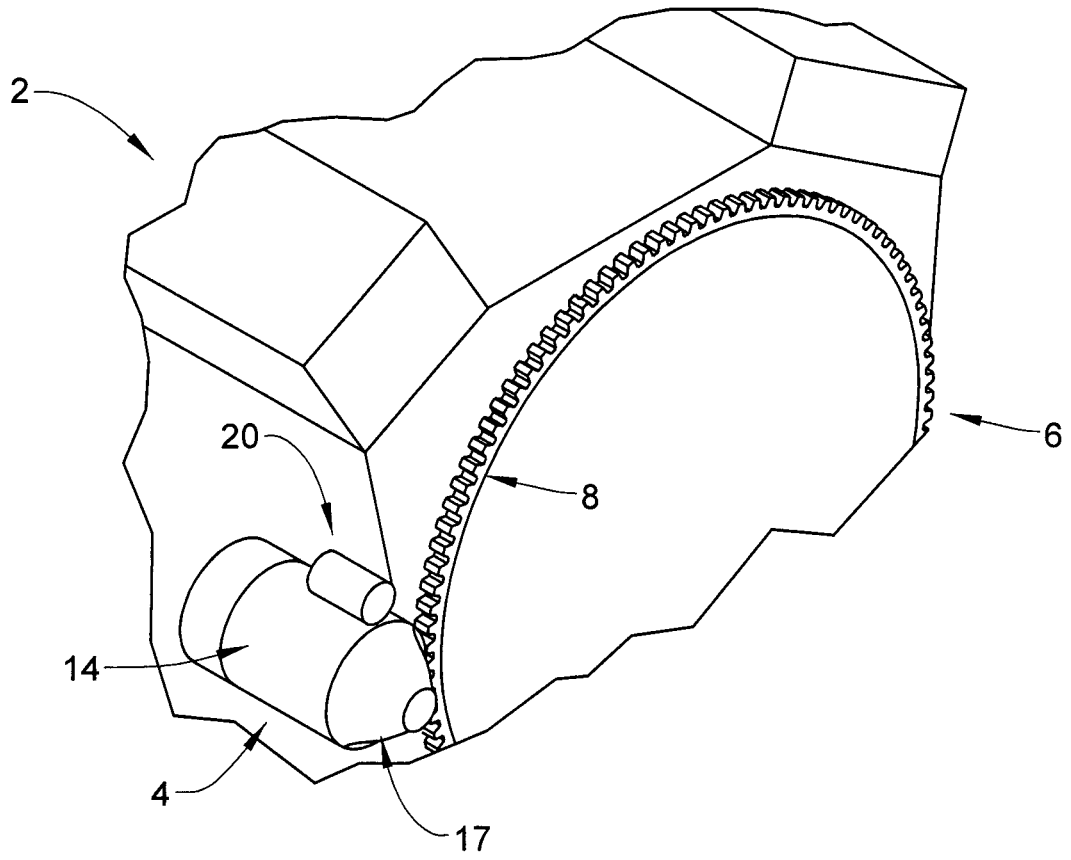
FIG. 1 depicts an internal combustion engine including a starter motor having a solenoid, in accordance with an exemplary embodiment.

An internal combustion engine, in accordance with an exemplary embodiment, is indicated generally at 2, in FIG. 1. Internal combustion engine 2 includes a starter motor 4 and a ring gear 6 having a plurality of ring gear teeth 8. Specifically, starter motor 4 engages and rotates ring gear 6 to initiate operation of internal combustion engine 2. Starter motor 4 includes a motor housing 14 and a nose or pinion housing 17. A solenoid 20 is operably coupled to motor housing 14. Starter motor 4 includes an output shaft (not shown) that supports an overrun clutch and a pinion gear (also not shown) that selectively engages with ring gear 6.

Figure 2:
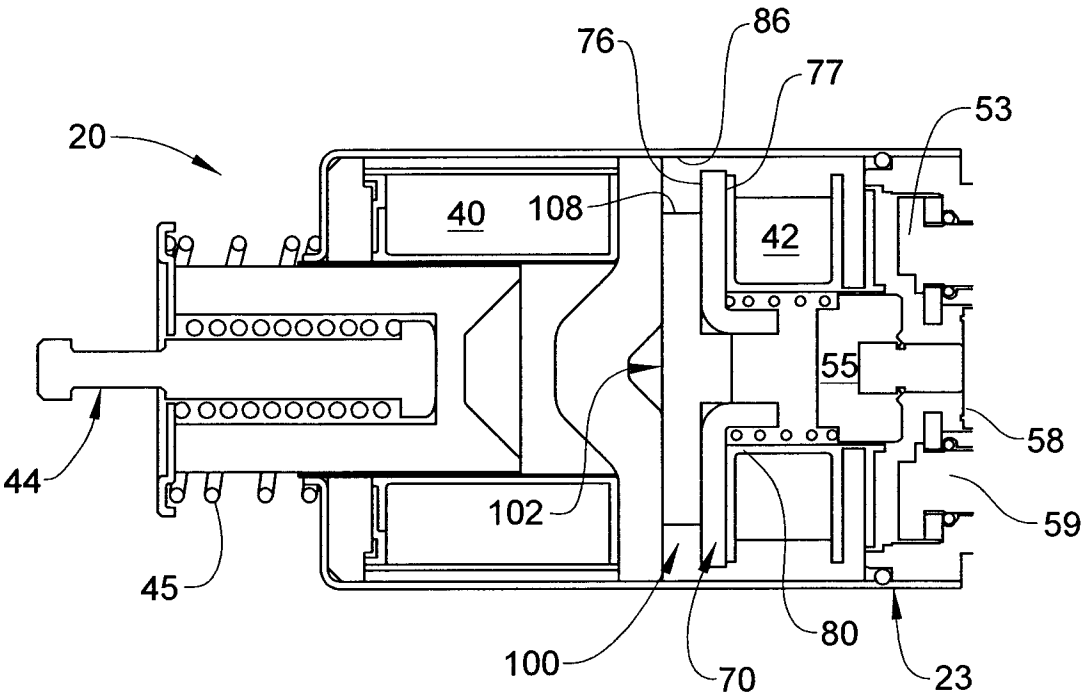
FIG. 2 depicts a partial cross-sectional view of the solenoid of FIG. 1.

As shown in FIG. 2, solenoid 20 includes a housing 23 that surrounds first and second coils 40 and 42 and a plunger assembly 44. Plunger assembly 44 is operably coupled to a lever (not shown) and includes a return spring 45. Electrical energy passing through switch terminals (not shown) energizes one or more of coils 40 and 42. Coil 40 creates a magnetic flux that draws in actuator assembly 44 causing the lever to shift the pinion gear along the output shaft and into engagement with ring gear 6, as will be detailed more fully below. Second coil 42 includes an actuator 55 that establishes a flow of electrical energy through a terminal 53 through a contact 58 to a second terminal 59 causing starter motor 4 to be energized and the pinion gear to rotate.

Figure 3:
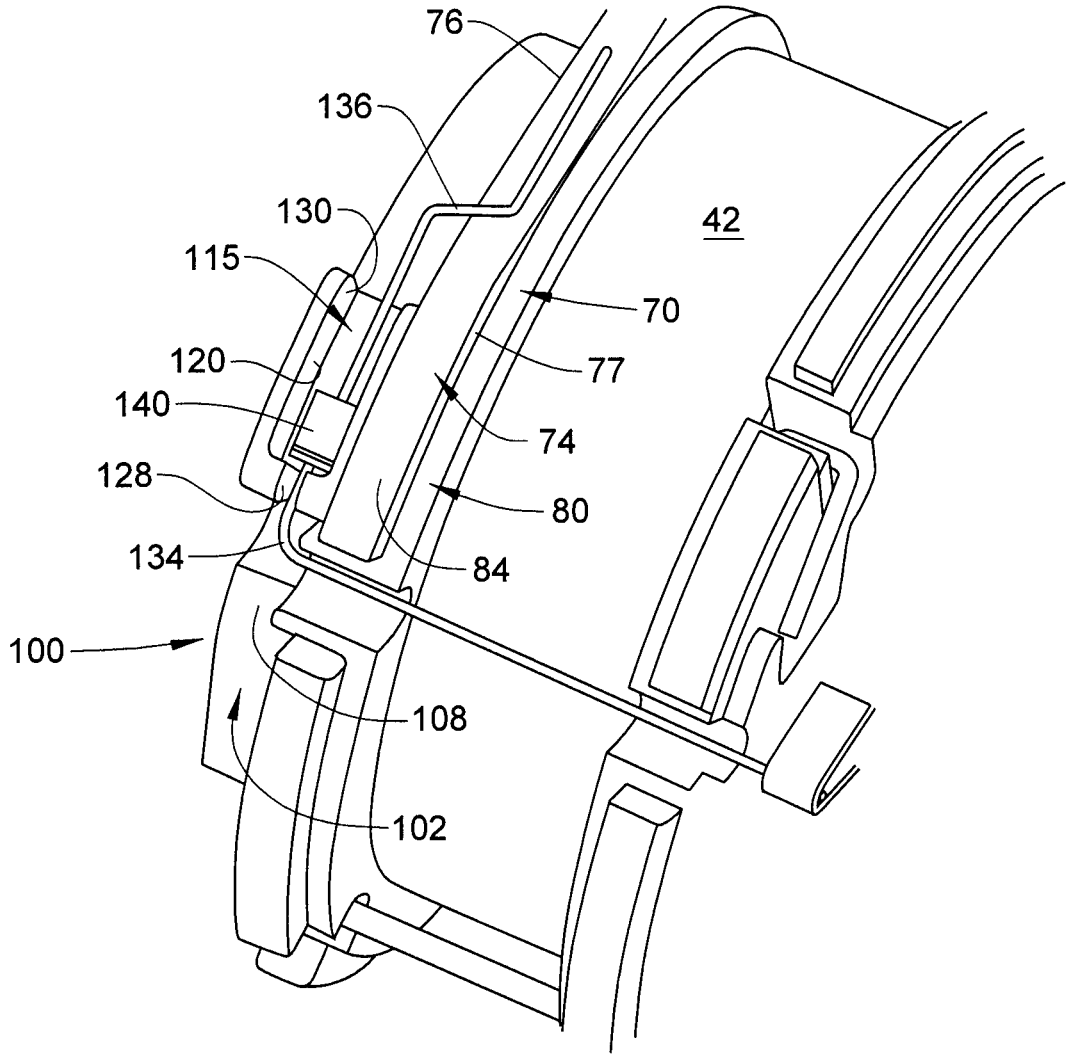
FIG. 3 depicts a partial perspective view of a diode mounting plate of the solenoid of FIG. 2.

Solenoid 20 includes a stop member 70 arranged adjacent to second coil 42, as shown in FIG. 3. Stop member 70 defines a travel limiter for actuator 55. Stop member 70 includes a body 74 formed from an electrically conductive material. Body 74 includes a first axial surface 76 and a second axial surface 77. Second axial surface 77 abuts a spool 80 that supports second coil 42. Body 74 also includes an outer circumferential edge 84, at least a portion of which contacts an inner surface 86 of housing 23 establishing an electrical ground.

Figure 4:
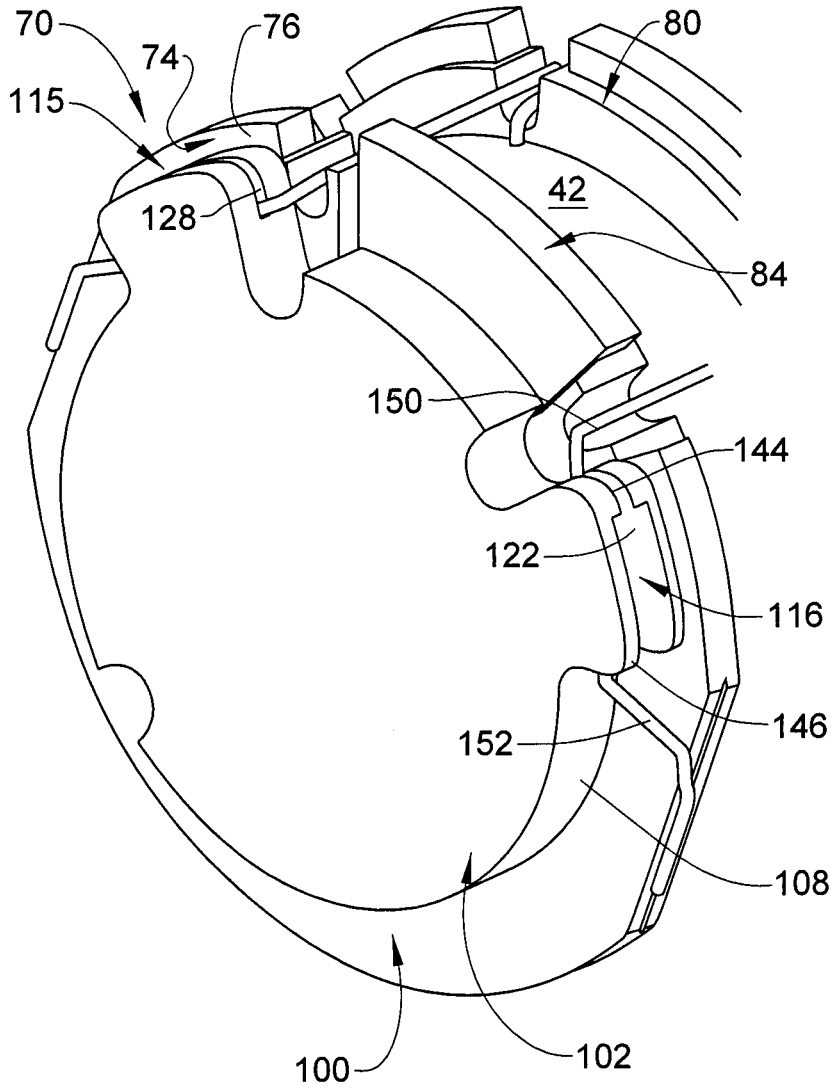
FIG. 4 depicts a partial perspective end view of the diode mounting plate of FIG. 3.

In accordance with an exemplary embodiment, solenoid 20 includes a diode holder 100 arranged adjacent stop member 70. As shown in FIGS. 3 and 4, diode holder 100 includes a body 102 formed from a non-electrically conductive material such as nylon, Acrylonitrile-Butadiene-Styrene (ABS) plastic or the like. Body 102 includes an outer circumferential edge 108. In the exemplary embodiment shown, diode holder 100 includes a first diode pocket 115 and a second diode pocket 116. First diode pocket 115 takes the form of a first recess 120 formed in outer circumferential edge 108. Similarly, second diode pocket 116 takes the form of a second recess 122 spaced from first recess 120 formed in outer circumferential edge 108.

First recess 120 includes a first passage 128 and a second passage 130. First and second passages 128, 130 receive corresponding first and second leads 134 and 136 of a first diode 140. Second recess 122 includes a third passage 144 and a fourth passage 146 that receive third and fourth leads 150 and 152 of a second diode (not shown). Diode holder 100 provides support and protection for first diode 144 and the second diode connected to first and second coils 40 and 42. First diode 144 and the second diode protect solenoid 20 from voltage spikes that may occur when energizing starter motor 4. Thus, a diode associated with each coil 40 and 42 enhances an overall service life and reliability of motor vehicle starting system components.

Figure 5:
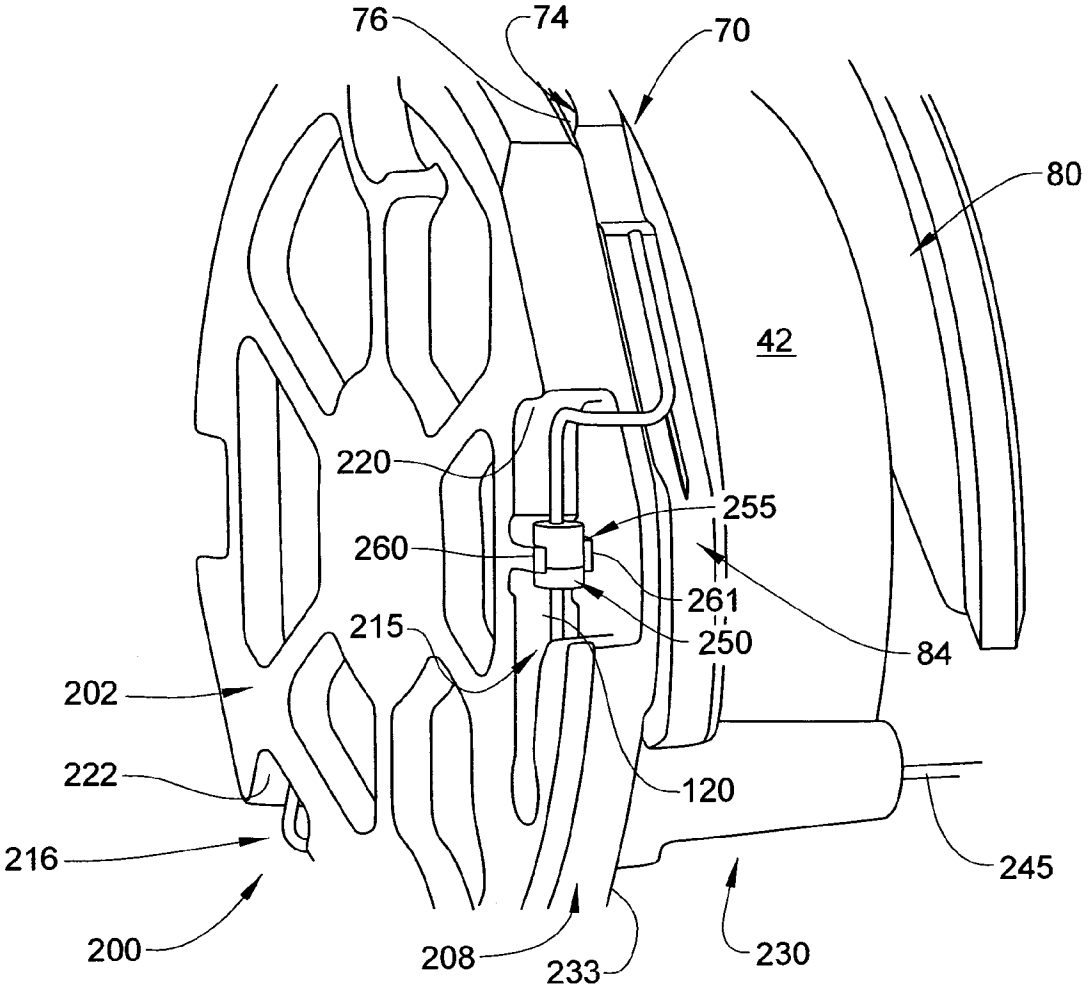
FIG. 5 depicts a partial perspective end view of the diode mounting plate in accordance with another aspect of an exemplary embodiment.

In accordance with another aspect of an exemplary embodiment illustrated in FIG. 5, solenoid 20 includes a diode holder 200 arranged adjacent stop member 70. Diode holder 200 includes a body 202 formed from a non-electrically conductive material such as nylon, Acrylonitrile-Butadiene-Styrene (ABS) plastic, or the like. Body 202 includes an outer circumferential edge 208. In the exemplary embodiment shown, diode holder 200 includes a first diode pocket 215 and a second diode pocket 216. First diode pocket 215 takes the form of a first recess 220 formed in outer circumferential edge 208. Similarly, second diode pocket 216 takes the form of a second recess 222 spaced from first recess 220 formed in outer circumferential edge 208. A lead passage 230 extends from an inner surface 233 of diode holder 200. Lead passage 230 directs and protects a diode lead 245 passing from first diode pocket 215 toward spool 80. Another lead passage (not shown) may extend from inner surface 233 adjacent to second diode pocket 216.

In accordance with the exemplary aspect shown, first recess 220 includes a diode retention feature 250 that snap-fittingly receives a first diode 255 arranged in first diode pocket 215. Diode retention feature 250 includes a first retaining member 260 and a second retaining member 261. In accordance with an aspect of an exemplary embodiment, first and second retaining members 260 and 261 are integrally formed with, and cantilevered from, an inner surface (not separately labeled) of first recess 220. First and second retaining members 260 and 261 are configured to elastically deform to receive first diode 255. Once received, first and second retaining members 260 and 261 exert a biasing force on first diode 255. At this point, it should be understood that second diode pocket 216 may include another diode retaining feature (not shown).

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. An internal combustion engine comprising:
an engine block;
a ring gear mounted relative to the engine block;
a starter motor mounted to the engine block at the ring gear, the starter motor including a motor housing, a pinion housing and a solenoid mounted relative to one of the motor housing and the pinion housing, the solenoid comprising:
a solenoid housing;
at least one coil arranged in the housing; and
at least one diode holder arranged in the housing adjacent the at least one coil, the at least one diode holder including a body having an outer circumferential edge and at least one diode pocket, the at least one diode pocket housing a diode electrically connected to the at least one coil.

2. The internal combustion engine according to claim 1, wherein the at least one diode holder comprises a recess formed in the body.

3. The internal combustion engine according to claim 1, wherein the at least one diode holder comprises a first diode pocket and a second diode pocket.

4. The internal combustion engine according to claim 1, wherein the at least one diode holder includes a first passage passing through the body and a second passage passing through the body.

5. The internal combustion engine according to claim 1, wherein the body is formed from a non-electrically conductive material.

6. The internal combustion engine according to claim 1, wherein the solenoid includes a first coil and a second coil, the at least one diode pocket including a first diode pocket housing a first diode electrically connected to the first coil and a second diode electrically connected to the second coil.

7. A motor vehicle starter motor comprising:
a motor housing;
a pinion housing; and
a solenoid mounted relative to one of the motor housing and the pinion housing, the solenoid comprising:
a solenoid housing;
at least one coil arranged in the housing; and
at least one diode holder arranged in the housing adjacent the at least one coil, the at least one diode holder including a body having an outer circumferential edge and at least one diode pocket, the at least one diode pocket housing a diode electrically connected to the at least one coil.

8. The motor vehicle starter motor according to claim 7, wherein the at least one diode holder comprises a recess formed in the body.

9. The motor vehicle starter motor according to claim 8, wherein the recess is formed in the outer circumferential edge.

10. The motor vehicle starter motor according to claim 7, wherein the at least one diode holder comprises a first diode pocket and a second diode pocket.

11. The motor vehicle starter motor according to claim 7, wherein the at least one diode holder includes a first passage passing through the body and a second passage passing through the body.

12. The motor vehicle starter motor according to claim 7, wherein the body is formed from a non-electrically conductive material.

13. The motor vehicle starter motor according to claim 7, wherein the solenoid includes a first coil and a second coil, the at least one diode pocket including a first diode pocket housing a first diode electrically connected to the first coil and a second diode electrically connected to the second coil.

* * * * *